US007429952B2

(12) United States Patent
Sun

(10) Patent No.: US 7,429,952 B2
(45) Date of Patent: Sep. 30, 2008

(54) BROADBAND APERTURE COUPLED GNSS MICROSTRIP PATCH ANTENNA

(75) Inventor: Jia Sun, Calgary (CA)

(73) Assignee: Hemisphere GPS Inc., Calgary, Alberta (CA)

( * ) Notice: Subject to any disclaimer, the term of this patent is extended or adjusted under 35 U.S.C. 154(b) by 458 days.

(21) Appl. No.: 11/316,854

(22) Filed: Dec. 23, 2005

(65) Prior Publication Data

US 2007/0146206 A1 Jun. 28, 2007

(51) Int. Cl.
*H01Q 1/38* (2006.01)

(52) U.S. Cl. ..... 343/700 MS

(58) Field of Classification Search ..... 343/700 MS, 343/702, 846–848, 850–853
See application file for complete search history.

(56) References Cited

U.S. PATENT DOCUMENTS

| | | | | |
|---|---|---|---|---|
| 5,200,756 | A | 4/1993 | Feller | |
| 5,815,122 | A | 9/1998 | Nurnberger et al. | |
| 5,861,848 | A | 1/1999 | Iwasaki | |
| 6,111,549 | A | 8/2000 | Feller | |
| 6,140,968 | A | 10/2000 | Kawahata et al. | |
| 6,166,692 | A | 12/2000 | Nalbandian et al. | |
| 6,252,553 | B1 | 6/2001 | Solomon | |
| 6,445,354 | B1 | 9/2002 | Kunysz | |
| 6,597,316 | B2 | 7/2003 | Rao et al. | |
| 6,900,766 | B2 * | 5/2005 | Komatsu et al. | 343/700 MS |
| 7,289,064 | B2 * | 10/2007 | Cheng | 343/700 MS |
| 7,307,590 | B1 * | 12/2007 | Tonn | 343/700 MS |
| 2006/0244610 | A1 * | 11/2006 | Cox | 340/572.7 |
| 2006/0250253 | A1 * | 11/2006 | Liu | 340/572.7 |

OTHER PUBLICATIONS

F. Yang and Y. Rahmet-Samii, "A single layer dual band circularly polarized microstrip antenna for GPS application", IEEE Antenna and Propagation Society International Symposium, vol. 4, pp. 720-723,Jun.2002.

K.Padhi, N.C.Karmakar, and C.L.Law,"An EM-coupled dual-polarized microstrip patch antenna for RFID applications", Microwave and optical technology letters, vol. 39, No. 5, pp. 354-360, 2003.

* cited by examiner

*Primary Examiner*—Huedung Mancuso
(74) *Attorney, Agent, or Firm*—Mark E. Brown

(57) ABSTRACT

A multilayer antenna structure configured to receive Global Navigation Satellite System (GNSS) and augmentation signals. The antenna includes a microstrip patch radiation element disposed at a top layer and a ground plane forming a first interior layer, the ground plane including at least two coupling apertures, and the ground plane isolated from said radiation element by a low loss dielectric. The antenna structure also includes a bottom layer, the bottom layer is isolated from the ground plane by another dielectric; at least two feed lines operably connected to a hybrid coupler disposed on the bottom layer; and an active circuit on the bottom layer, a first port of said active circuit operably connected to the hybrid coupler.

23 Claims, 6 Drawing Sheets

BROADBAND APERTURE COUPLED GNSS MICROSTRIP PATCH ANTENNA

FIELD OF THE INVENTION

The invention relates generally to a broadband microstrip antenna as may be employed for radio navigation, more specifically, to an antenna for receiving a right-hand circularly polarized Global Navigation Satellite System (GNSS) signal, particularly a Global Positioning System (GPS) signal.

BACKGROUND OF THE INVENTION

A Global Navigation Satellite System (GNSS) includes a network of satellites that broadcast radio signals, enabling a user to determine the location of a receiving antenna with a high degree of accuracy. Examples of GNSS systems include Navstar Global Positioning System (GPS), established by the United States; Globalnaya Navigatsionnay Sputnikovaya Sistema, or Global Orbiting Navigation Satellite System (GLONASS), established by the Russian Federation and similar in concept to GPS; and Galileo, also similar to GPS but created by the European Community and slated for full operational capacity in 2008.

Currently the best-known of the available GNSS, GPS was developed by the United States government and has a constellation of 24 satellites in 6 orbital planes at an altitude of approximately 26,500 km. Each satellite continuously transmits microwave L-band radio signals in two frequency bands, L1 (1575.42 MHz) and L2 (1227.6 MHz). The L1 and L2 signals are phase shifted, or modulated, by one or more binary codes. These binary codes provide timing patterns relative to the satellite's onboard precision clock (synchronized to other satellites and to a ground reference through a ground-based control segment), in addition to a navigation message giving the precise orbital position of each satellite, clock correction information, and other system parameters.

The binary codes providing the timing information are called the C/A Code, or coarse acquisition code, and the P-code, or precise code. The C/A Code is a 1 MHz Pseudo Random Noise (PRN) code modulating the phase of the L1 signal and repeating every 1023 bits (one millisecond). The P-Code is also a PRN code, but modulates the phase of both the L1 and L2 signals and is a 10 MHz code repeating every seven days. These PRN codes are known patterns that can be compared to internal versions in the receiver. The GNSS receiver is able to compute an unambiguous range to each satellite by determining the time-shift necessary to align the internal code to the broadcast code. Since both the C/A Code and the P-Code have a relatively long "wavelength"—approximately 300 meters (or 1 microsecond) for the C/A Code and 30 meters (or 1/10 microsecond) for the P-Code, positions computed using them have a relatively coarse level of resolution.

Commonly it is desirable to improve the accuracy, reliability, or confidence level of an attitude or position determined through use of a GNSS, a Satellite-Based Augmentation System (SBAS) may be incorporated if one that is suitable is available. There are several public SBAS that work with GPS. These include Wide Area Augmentation System (WAAS), developed by the United States' Federal Aviation Authority, European Geostationary Navigation Overlay Service (EGNOS), developed by the European Community, as well as other public and private pay-for-service systems such as OmniSTAR®.

Conventional GPS antennas include ceramic patch, cross diploes and microstrip patch. The ceramic patch is of compact size and has the benefit of low cost but its bandwidth is narrow and it cannot be used in high accuracy applications. The cross dipole antenna has a high gain at low elevation angles and consequently exhibits less desirable multipath performance. It also has complicated assembly issues. There are numerous microstrip patch antennas in the art including commonly assigned U.S. Pat. No. 5,200,756 issued to Feller. This three dimensional microstrip patch antenna has high gain at low elevation angles but it exhibits less desirable multipath performance. U.S. Pat. No. 6,252,553, issued to Solomon is a multi-mode patch antenna system and method of forming and steering a spatial null. This antenna uses four feed probes and geometrical non-symmetry and the radiating patch is assembled over the ground plane. The active circuit employed also requires an additional circuit card. U.S. Pat. No. 6,445,354, issued to Kunysz is termed a pinwheel antenna design. The pinwheel antenna has nice performance including the ability to reduce multipath but it is difficult to manufacture compared to other antenna configurations. This antenna also employs two circuit cards, an RF absorber and a cable connection between both cards. U.S. Pat. No. 6,597,316 issued to Rao, et al., is a spatial null steering microstrip antenna array. This antenna also exhibits good multipath reducing properties and accuracy but its feed circuit is comparatively complicated, consisting of four coaxial probes and three combiners.

With respect to the existing designs for antennas, there still remains a need for improvements in compact packaging, ease of assembly, broadband reception, multipath mitigation, accuracy and sensitivity. It is also desirable to realize the above improvements using a microstrip patch antenna design. It is further desirable to provide a GPS antenna with broadband capabilities that covers both GPS signal bands and L-Band signals such as those broadcast for augmentation and differential corrections such as OmniSTAR® and the like. It would also be desirable to combine radiator, coupling apertures, feed circuit and active circuit into one single circuit card to enhance and compact structure, facilitate assembly, and ensure lower cost.

SUMMARY OF THE INVENTION

Disclosed herein is a multilayer antenna structure configured to receive Global Navigation Satellite System (GNSS) and augmentation signals. The antenna includes a microstrip patch radiation element disposed at a top layer and a ground plane forming a first interior layer, the ground plane including at least two coupling apertures, and the ground plane isolated from said radiation element by a low loss dielectric. The antenna structure also includes a bottom layer, the bottom layer is isolated from the ground plane by another dielectric; at least two feed lines operably connected to a hybrid coupler disposed on the bottom layer; and an active circuit on the bottom layer, a first port of said active circuit operably connected to the hybrid coupler.

In another exemplary embodiment the antenna further includes orthogonal apertures on the interior ground plane and orthogonal two feed lines on the bottom layer.

Also disclosed herein in yet another exemplary embodiment is a method of acquiring Global Navigation Satellite System (GNSS) and augmentation signals with a broadband multilayer antenna structure. The method includes receiving Global Navigation Satellite System (GNSS) and augmentation signals with a microstrip patch radiation element disposed at a top layer and coupling the signals to at least two feed lines with at least two coupling apertures formed in a ground plane disposed on a first interior layer. The ground plane is isolated from said radiation element by a low loss dielectric and the at least two feed lines are disposed on a bottom layer. The bottom layer is isolated from the ground plane by another dielectric. The method also includes transmitting the signals from the at least two feed lines to a hybrid coupler disposed on the bottom layer and amplifying and filtering the signals with an active circuit disposed on the bottom layer. A first port of the active circuit is operably connected to said hybrid coupler.

One advantage of an embodiment disclosed herein is a broadband GPS antenna that covers both the GPS signal band and L-Band signals such as those broadcast by OmniSTAR® for the purpose of differentially correcting a GPS receiver. Another advantage of one or more of the embodiments disclosed herein is a planar antenna with improved multipath mitigation. A further advantage of an embodiment of the invention disclosed here is the combination of radiator, coupling apertures, feed circuit and active circuit into one single printed circuit board (PCB) for compact structure, ease of assembly and low cost. Yet another advantage on one or more exemplary embodiments is that it employs an active circuit that includes a low noise amplifier and band-pass filter that yields high sensitivity when incorporated into the final antenna system.

Additional features, functions, and advantages associated with the disclosed methodology will be apparent from the detailed description which follows, particularly when reviewed in conjunction with the figures appended hereto.

BRIEF DESCRIPTION OF THE DRAWINGS

To assist those of ordinary skill in the art in making and using the disclosed embodiments, reference is made to the appended figures, wherein like references are generally numbered alike in the several figures.

DETAIL DESCRIPTION OF THE EXEMPLARY EMBODIMENTS

Disclosed herein in one or more exemplary embodiments is a planar antenna including a circular microstrip patch radiation element etched on the substrate, dual orthogonal apertures on an interior ground plane, and two feed lines, a hybrid coupler and an active circuit on a bottom substrate. When a GNSS signal, and in particular a GPS signal and/or an augmentation signal is picked up by the top layer circular microstrip patch radiation element and coupled to feed lines on the bottom layer by slot apertures on the ground plane, a 90° phase shift is generated by the hybrid coupler and feed lines. The resulting right-hand circularly polarized GPS signal is then directed to a low noise amplifier and filter circuit via one hybrid coupler output port. A load impedance is employed on another output port of the hybrid coupler to absorb the reflecting power from possibly unmatched antenna feed ports. In one exemplary embodiment, the antenna configuration is simulated to enhance and optimize the antenna element gain, pattern, axial ratio, phase shift, matching, noise figure, and frequency response. The resulting microstrip antenna has the benefit of compact size, it enables broadband reception (GNSS and augmentation e.g., OmniSTAR®), it reduces multipath, has a good axial ratio, a good frequency response, a low noise figure and is easily assembled.

Figure 1:
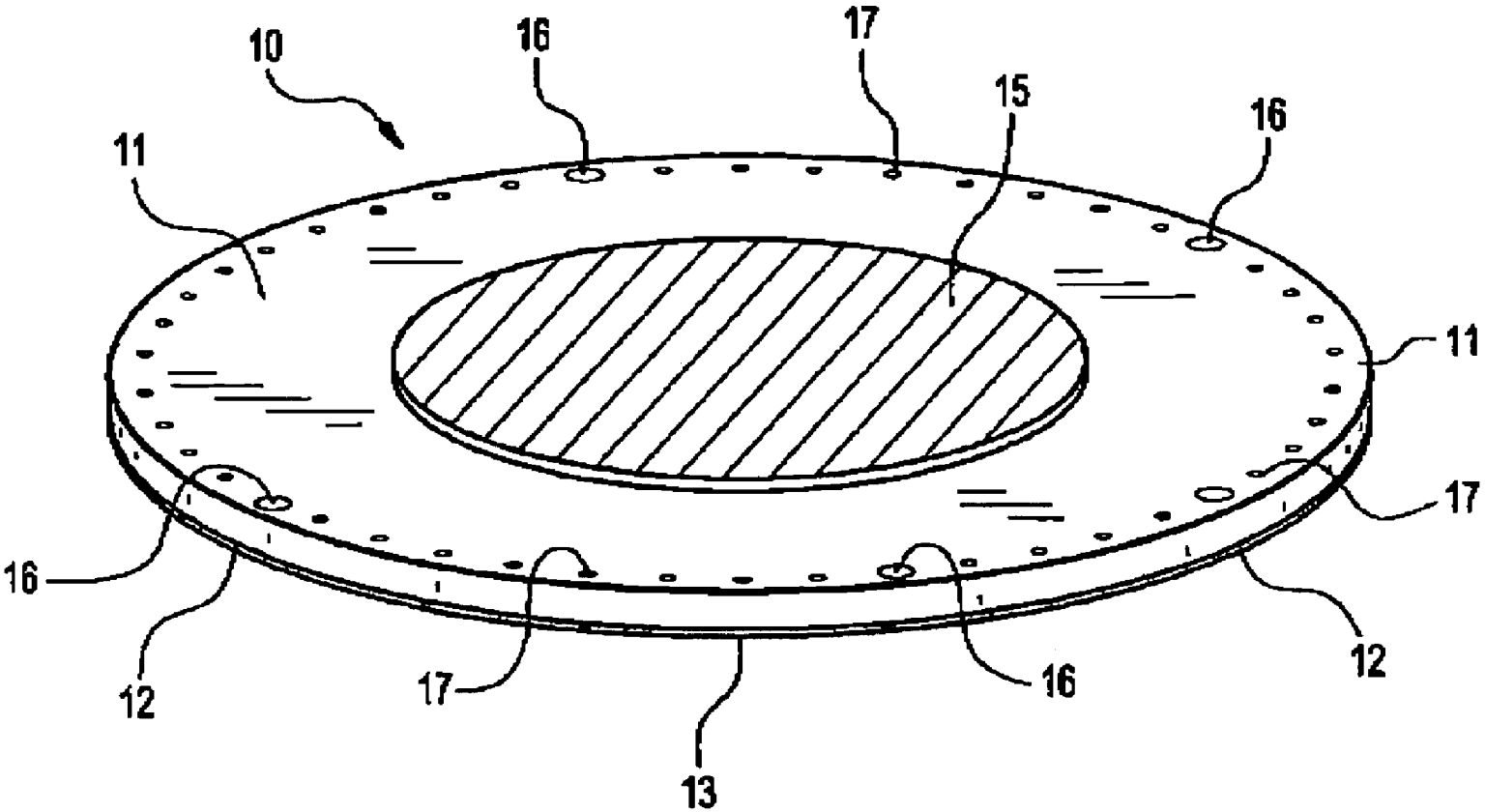
FIG. 1 depicts a perspective view for an exemplary embodiment of the antenna.
Figure 2:
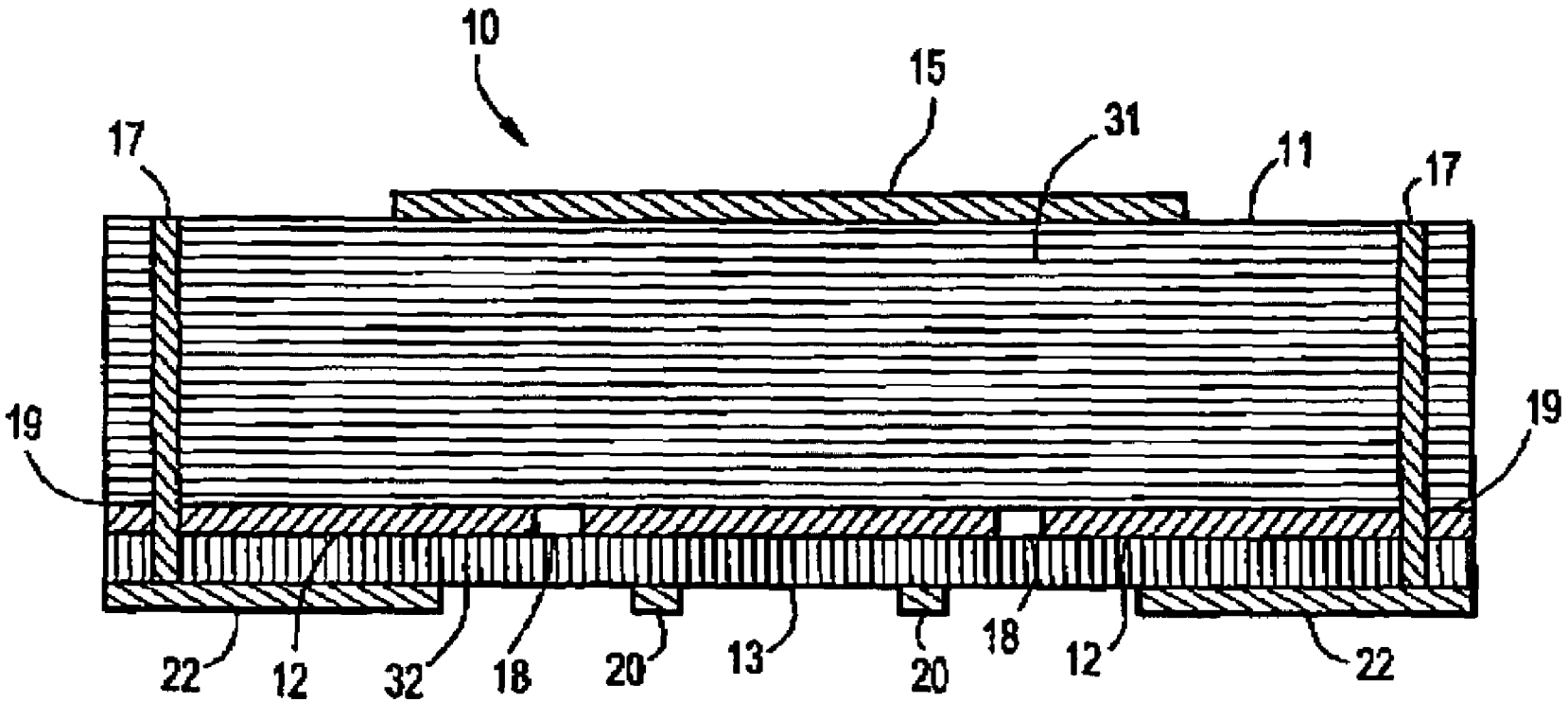
FIG. 2 depicts a cross section view for an exemplary embodiment of the antenna.

FIGS. 1 and 2 provide a perspective and cross sectional view, respectively, of the antenna 10 of an exemplary embodiment. The antenna 10 is described herein as including a series of layers in a compact, integrated structure. A first, and top layer 11, is a microstrip patch radiation element 15 directed skyward to receive signals from the GPS satellites and augmentation systems. Dielectric material 31 resides between top layer 11 with radiation element 15 and a middle conductive layer 12 configured as a ground plane 19. In an exemplary embodiment, the dielectric material is selected to ensure maximum gain and bandwidth for a given implementation of the antenna 10. In one exemplary embodiment, Arlon CLTE™ is used as the dielectric material 31 because it is a ceramic/PTFE composite exhibiting low water absorption, high thermal conductivity, low loss, tight dielectric constant (DK) and it allows for precise thickness tolerances. The middle layer 12 of the antenna 10 with the ground plane 19 isolates the radiation element 15 of the top layer from a feed circuit 21 and active circuit 24 on the bottom layer 13. The middle layer 12 also includes coupling apertures 18 to couple the radio frequency (RF) signals to the feed circuit 20, 21. FR4 is used as a dielectric structural material 32 between the middle layer 12 with ground plane 19 and the bottom layer 13 with the feed circuit 20. This dielectric is not as critical and FR4 is chosen because of its desirable structural properties and low cost.

Figure 3:
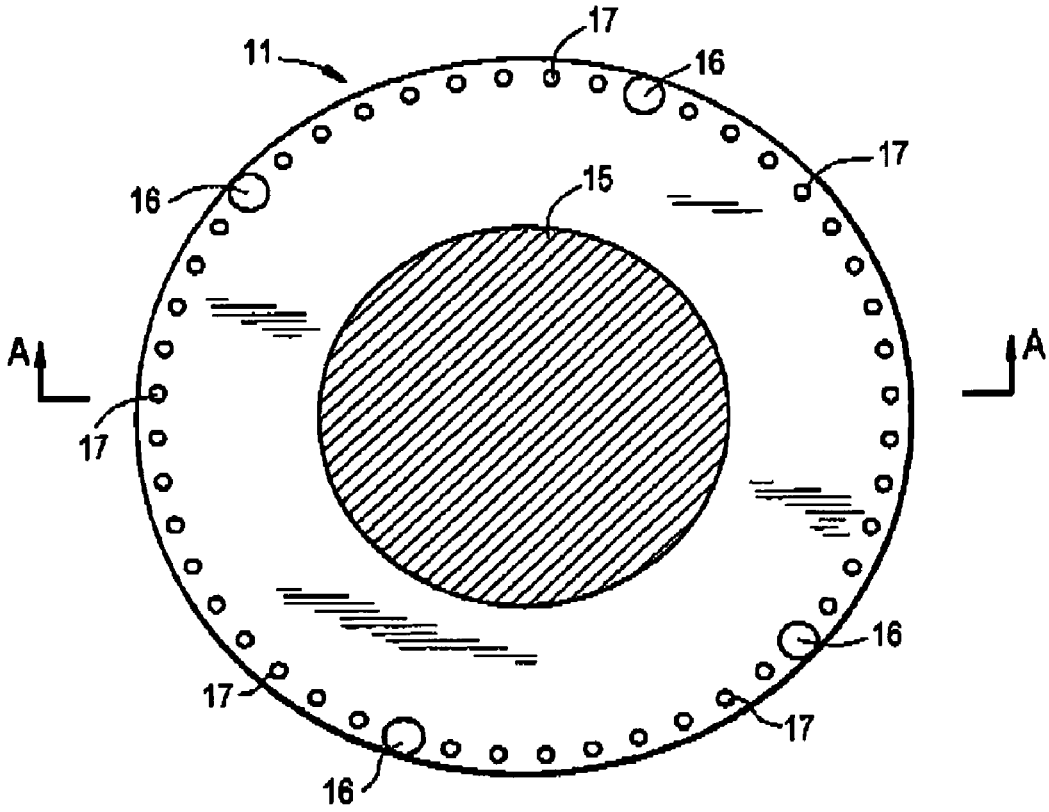
FIG. 3 depicts an exemplary embodiment of the microstrip patch on the top layer.

Turning now to FIG. 3, a top layer 11 of the antenna 10 exhibiting a circular microstrip patch as a radiation element 15 is depicted. In an exemplary embodiment the radiation element 15 is preferably configured to be of circular shape. It will be readily appreciated that while a circular radiation element 15 is described in the exemplary embodiment, other shapes are possible and may be elected for implementation. It will be further appreciated that a non-circular radiator would generate a position bias from the antenna 10 at some orientations as a result of the geometrical asymmetry. However, such a configuration may be beneficial for selected implementations. In an exemplary embodiment, the radius of circular microstrip patch radiation element 15 is designed based on the thickness and dissipation factor for the dielectric material 31.

A plurality of via holes 17 are substantially distributed around the perimeter of the top layer 12 and are connected to interior ground plane 19 (FIG. 4) and the bottom layer ground 22 (FIG. 5) and provide a multipath reducing functionality. In an exemplary embodiment, the sizing and spacing of the via holes 17 is configured such that in concert they provide shielding to attenuate extraneous, off axis electromagnetic interference. For example, in one embodiment, the spacing between via holes 17 is maintained at less than a wavelength divided by 10 e.g., ($\lambda/10$) and all via holes 17 are disposed geometrically symmetrical to the antenna center. A plurality of mounting holes 16 are also connected to via holes 17 as well as common ground plane 19. Mounting holes 16 are also connected to the enclosure ground (not shown) and via holes 17 to reduce the interference from other radio sources. In an exemplary embodiment, four mounting holes are employed.

Figure 4:
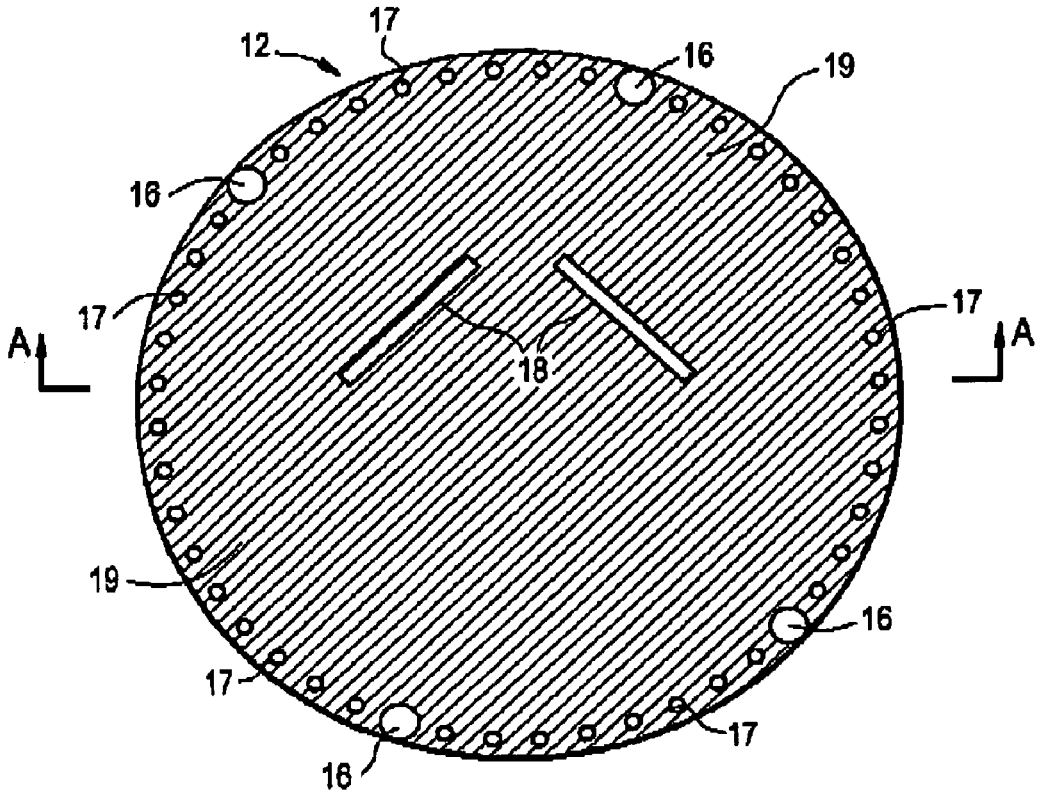
FIG. 4 depicts the coupling apertures on the interior ground plane in accordance with an exemplary embodiment.
Figure 5:
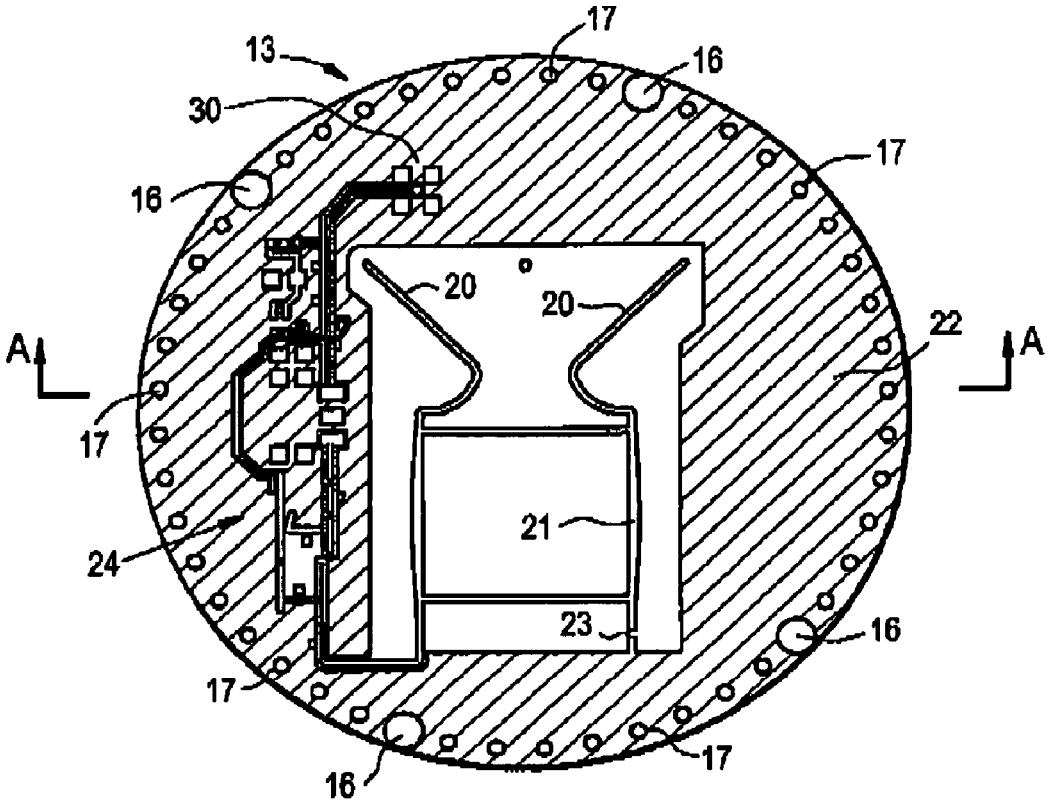
FIG. 5 depicts the feed lines and hybrid coupler on the bottom layer in accordance with an exemplary embodiment.

Turning now to FIGS. 4 & 5, FIG. 4 depicts an interior ground plane 19 with two coupling feed apertures 18 formed therein. In an exemplary embodiment, the interior ground plane 19 and feed apertures 18 form the middle layer 12 of the antenna 10. FIG. 5 depicts the bottom layer 13 of the antenna 10 with orthogonal feed strips 20 of a hybrid coupler 21 and active circuit 24 including a low noise amplifier 25, band pass filter 26 and RF buffer 27 integrated with feed circuit 20 and hybrid coupler 21 together for ease of matching, realization of low noise figure, and realization of small size.

In an exemplary embodiment, the feed apertures 18 comprise two rectangular non-resonant slots in the interior ground plane 19 of the middle layer 12 of the antenna 10. The positions, orientation and dimensions of both feed apertures 18 are designed based on the characteristics of the dielectric materials 31 and 32, including, but not limited to thickness and dissipation factor. Both rectangular slots 18 are configured to be orthogonal and substantially geometrically symmetrical to the antenna center. The apertures 18 are separately perpendicular to the respective feed strips 20 of the hybrid coupler 21 on the bottom layer 13 of the antenna 10. The hybrid coupler 21 is connected to the two feed lines 20 which pick up the radio frequency RF signal from the top layer 11 radiation element 15 through the coupling apertures 18 on the interior ground plane 19. The orientation and configuration of the apertures 18 and feed lines 20 ensures that the signal coupled through the hybrid coupler 21 is right hand circularly polarized. In an exemplary embodiment the hybrid coupler includes two input ports and two output ports. The two input ports of the hybrid coupler are connected to each feed line 20, while a first output port is coupled to the active circuit 24. In an exemplary embodiment the hybrid coupler 21 is configured to exhibit good isolation between the feed lines 20. In one exemplary embodiment a load is connected to a second output port of the hybrid coupler to balance any mismatch of impedances if the feed lines 20 or with the active circuit 24 and thus, absorb reflecting power resultant from any mismatch.

Ultimately, a coupler 21 with good isolation between input ports and between input ports and output ports and exhibiting substantially a 90° of phase difference are desirable to ensure coupling of only right-hand circular polarization of radiating signal and achieving a desirable axial ratio. The location and dimensions of the feed lines 20 and hybrid coupler 21 are based on characteristics of the apertures 18 as well as the characteristics of the dielectric material 32, such as thickness and dissipation factor. Preferably, to ensure desirable performance, both feed lines 20 are configured to be orthogonal and geometrically symmetrical to the antenna center and as stated earlier orthogonal to the apertures 18. It will be readily appreciated that the antenna performance is particularly sensitive to the positioning and dimensioning of the apertures 18. The configuration of the sizing of the radiation element 15, thickness and properties of the dielectric 31 as well as the size and orientation of the apertures 18 and feed lines 20 are interrelated. In an exemplary embodiment, the design of the radiation element, apertures 18 and feed circuit are configured based on a three-dimensional modeling, simulation, and optimization. In an exemplary embodiment, a commercially available modeling and simulation application IE3D was employed to facilitate design and optimization. It will be readily appreciated that while the exemplary embodiments are described with respect to the design of a broadband antenna specifically configured for receipt of both GPS and OmniSTAR® signals, such description is merely illustrative and not limited to GPS and OmniSTAR® alone. The antenna structures of the exemplary embodiments may readily be adapted to capture signals from other GNSS and of varying frequencies with deviation from the scope and breadth of the appended claims. Furthermore, while the exemplary embodiment has been described with respect to employing two apertures 18 and two feed lines 20, other configurations are possible.

Advantageously, in the exemplary embodiments described herein, an aperture coupled feed technique is employed, which makes the antenna 10 more compact because a feed circuit 20 and hybrid coupler 21 may be readily fabricated on the bottom layer 13 of the antenna and the same substrate as the middle layer 19 with the apertures 18 and ground plane 19. It will be appreciated that common microstrip antennas of prior art typically use two orthogonal patch modes in phase quadrature to achieve circular polarization. Most circularly polarized patch antennas of the existing art utilize two adjacent sides of a circle or square patch with signals of equal amplitude and 90° phase difference. Additional benefits of this aperture coupled feed technique employed in the exemplary embodiments are the isolation formed between radiation element 15 of the top layer 11 and feed strip 20 and active circuits 24, on the bottom layer 13 of the antenna 10 by the interior ground plane 19 which reduces interference from external sources.

Figure 6:
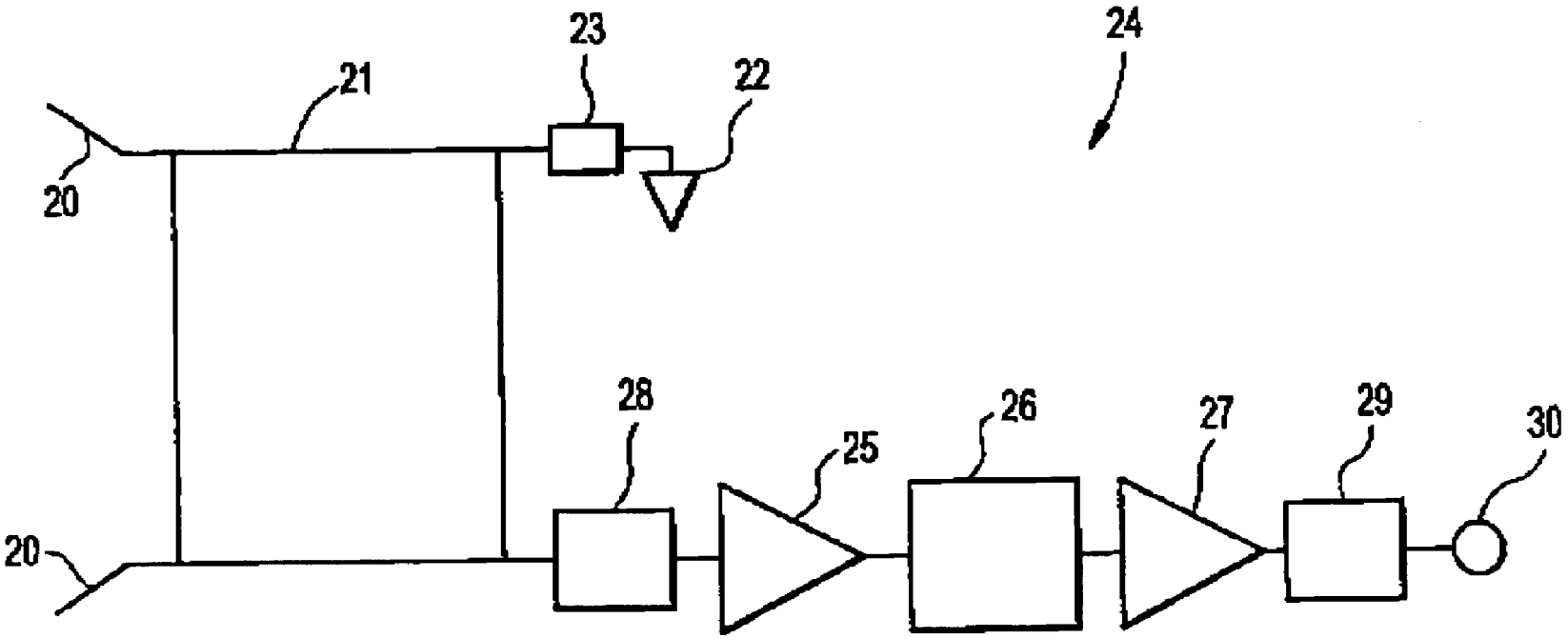
FIG. 6 depicts an active circuit of an exemplary embodiment including a low noise amplifier, a band pass filter and a RF buffer.

FIG. 6 shows an illustrative block diagram of an exemplary embodiment of an active circuit 24 including low noise amplifier 25, band-pass filter 26 and RF buffer 27. The low noise amplifier 25 is connected to the output port of the hybrid coupler 21 port, preferably, as closely as possible to reduce the insertion loss coupling, mismatch, and the like from the transmission line. In an exemplary embodiment, noise matching 28 is employed and preferably optimized for the low noise amplifier 25. In one exemplary embodiment the active device for the low noise amplifier 25 is a SiGe transistor. A SiGe transistor is used to take advantage of its low noise figure. In one exemplary embodiment an amplifier 25 with a noise figure less than 1 dB is employed. In an exemplary embodiment, the band-pass filter 26 that follows the low noise amplifier 25 is a ceramic band-pass filter having both GPS and OmniSTAR® frequency coverage while rejecting out of band RF signals. Preferably, this bandpass filter 26 exhibits flat response within about 1 dB and linearity in the pass-band, although, wider responses may be utilized without impact. The final stage RF buffer 27 and impedance matching 29 generates enough gain and provides desirable good impedance matching at the output 30 of the antenna system 10 to drive receiver loads as typically required.

It will be appreciated that while the exemplary embodiments are described as employing an amplifier and filter with certain characteristics, one skilled in the art would readily appreciate that such characteristics are not limiting. Similar means of implementation employing elements with less desirable characteristics may be employed to achieve the desired overall functionality without loss of generality. Likewise, it will be evident that there exist numerous methodologies in the art for implementation of the amplifiers, filters, functions, in particular as referenced here, including, but not limited to, linearizations, approximations, filters, band pass filters, taking maximums, summations, and the like. While many possible implementations exist, a particular method of implementation as employed to illustrate the exemplary embodiments should not be considered limiting.

It will be appreciated that the use of "first" and "second" or other similar nomenclature for denoting similar items is not intended to specify or imply any particular order unless otherwise specifically stated. Likewise the use of "a" or "an" or other similar nomenclature is intended to mean "one or more", unless otherwise specifically stated.

While the invention has been described with reference to an exemplary embodiment thereof, it will be understood by those skilled in the art that the present disclosure is not limited to such exemplary embodiments and that various changes may be made and equivalents may be substituted for elements thereof without departing from the scope of the invention. In addition, a variety of modifications, enhancements, and/or variations may be made to adapt a particular situation or material to the teachings of the invention without departing from the essential spirit or scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A multilayer antenna structure configured to receive Global Navigation Satellite System (GNSS) and augmentation signals comprising:

a microstrip patch radiation element disposed at a top layer;

a ground plane forming a first interior layer, said ground plane including at least two coupling apertures, said ground plane isolated from said radiation element by a low loss dielectric;

a bottom layer, said bottom layer isolated from said ground plane by another dielectric;

at least two feed lines operably connected to a hybrid coupler disposed on said bottom layer; and an active circuit on said bottom layer, a first port of said active circuit operably connected to said hybrid coupler.

2. The antenna of claim 1, wherein said microstrip patch radiation element is substantially circular.

3. The antenna of claim 1, wherein said at least two coupling apertures are substantially rectangular non-resonant slots and orthogonal.

4. The antenna of claim 1, wherein each of said at least two feed lines is orthogonal.

5. The antenna of claim 1, wherein said at least two feed lines are under said at least two coupling apertures and orthogonal respectively.

6. The antenna of claim 1, wherein said active circuit includes at least one of a low noise amplifier, a band-pass filter, and an RF buffer.

7. The antenna of claim 6, further including a noise matching circuit operably connected between said hybrid coupler and said low noise amplifier.

8. The antenna of claim 6, further including a ceramic band pass filter operably connected between said low noise amplifier and said RF buffer, said filter configured to transmit both GPS and OmniSTAR® frequency range signals therebetween.

9. The antenna of claim 6, further including an impedance matching circuit operably connected between said RF buffer and an output connector for the antenna.

10. The antenna of claim 9, wherein said output connector is a surface mount device and is physically isolated from said interior ground plane and said radiation element.

11. The antenna of claim 1, wherein a second output port of said hybrid coupler is operably connected to a load to reduce impedance mismatch and reflections.

12. The antenna of claim 11, wherein said load is a 50Ω resister.

13. The antenna of claim 1, further including a plurality of via holes distributed substantially equally about a perimeter of the antenna and extending vertically through each layer of the multilayer antenna, said plurality of via holes conductively connected only to said ground plane and another ground plane on said bottom layer.

14. The antenna of claim 13, wherein said via holes are also connected to a plurality of mounting holes distributed about a perimeter of the antenna and extending vertically through each layer of the multilayer antenna, said plurality of via holes conductively connected only to said ground plane and another ground plane on said bottom layer.

15. The antenna of claim 1, further including a plurality of mounting holes distributed about a perimeter of the antenna and extending vertically through each layer of the multilayer antenna, said plurality of via holes conductively connected only to said ground plane and another ground plane on said bottom layer.

16. The antenna of claim 15, wherein said mounting holes are also connected to a plurality of via holes distributed substantially equally about a perimeter of the antenna and extending vertically through each layer of the multilayer antenna, said plurality of via holes conductively connected only to said ground plane and another ground plane on said bottom layer.

17. The antenna of claim 1, wherein said another ground plane is further connected to an enclosure ground.

18. The antenna of claim 1, wherein said first dielectric material is a very low loss PTFE based laminate.

19. The antenna of claim 1, wherein a thickness of said first dielectric is greater than a thickness of said another dielectric.

20. The antenna of claim 1, wherein said another dielectric material is FR4.

21. The antenna of claim 1, wherein said augmentation signal includes OmniSTAR® signals.

22. The antenna of claim 1, wherein said GNSS signals are GPS signals.

23. A method of acquiring Global Navigation Satellite System (GNSS) and augmentation signals with a broadband multilayer antenna structure comprising:

receiving Global Navigation Satellite System (GNSS) and augmentation signals with a microstrip patch radiation element disposed at a top layer;

coupling said signals to at least two feed lines with at least two coupling apertures formed in a ground plane disposed on a first interior layer, said ground plane isolated from said radiation element by a low loss dielectric; said at least two feed lines disposed on a bottom layer, said bottom layer isolated from said ground plane by another dielectric;

transmitting said signals from said at least two feed lines to a hybrid coupler disposed on said bottom layer; and amplifying and filtering said signals with an active circuit disposed on said bottom layer, a first port of said active circuit operably connected to said hybrid coupler.

* * * * *